US005328670A

United States Patent [19]

Hirabayashi et al.

[11] Patent Number: 5,328,670

[45] Date of Patent: Jul. 12, 1994

[54] METHOD OF TREATING NICKEL-CONTAINING ETCHING WASTE FLUID

[75] Inventors: Teruhiko Hirabayashi; Yoshiyuki Imagire; Toshiaki Kurihara; Eiichi Akiyoshi; Ryoichi Maekawa, all of Tokyo, Japan

[73] Assignees: Nittetu Chemical Engineering, Ltd., Tokyo; Kabushiki Kaisha Toshiba, Kawasaki, both of Japan

[21] Appl. No.: 854,565

[22] Filed: Mar. 20, 1992

[30] Foreign Application Priority Data

| | | | |
|---|---|---|---|
| Mar. 22, 1991 | [JP] | Japan | 3-130771 |
| Mar. 22, 1991 | [JP] | Japan | 3-130772 |
| Dec. 20, 1991 | [JP] | Japan | 3-361104 |

[51] Int. Cl.[5] ..... C01G 49/10; C01G 53/09

[52] U.S. Cl. ..... 423/140; 156/642; 203/48; 203/80; 423/493; 423/DIG. 1

[58] Field of Search ..... 423/140, DIG. 1, 493; 203/48, 80, 88; 156/642

[56] References Cited

U.S. PATENT DOCUMENTS

| | | | |
|---|---|---|---|
| 4,086,321 | 4/1978 | Holley et al. | 423/DIG 1. |
| 4,222,997 | 9/1980 | Beecher | 423/DIG. 1 |
| 5,057,290 | 10/1991 | Peterson et al. | 423/140 |

FOREIGN PATENT DOCUMENTS

| | | | |
|---|---|---|---|
| 55-23005 | 2/1980 | Japan . | |
| 176132 | 10/1983 | Japan | 423/140 |
| 59-31868 | 2/1984 | Japan . | |
| 59-190367 | 10/1984 | Japan . | |
| 61-44814 | 10/1986 | Japan . | |
| 62-222087 | 9/1987 | Japan . | |
| 62-222088 | 9/1987 | Japan . | |
| 63-10097 | 3/1988 | Japan . | |
| 1192708 | 8/1989 | Japan . | |
| 3291388 | 12/1991 | Japan . | |

OTHER PUBLICATIONS

John H. Perry, *Chemical Engineers' Handbook*, Fourth Edition (1963), McGraw-Hill Book Co., pp. 13-51 to 13-53.

*Primary Examiner*—Wayne Langel

*Attorney, Agent, or Firm*—Cushman, Darby & Cushman

[57] ABSTRACT

A method of regenerating an etching waste fluid, includes the steps of dissolving HCl gas in an etching waste fluid at a temperature falling within a range of 20° C. to 50° C. and crystallizing $NiCl_2$ and $FeCl_2$ crystals, the etching waste fluid containing $NiCl_2$, $FeCl_3$, and $FeCl_2$ and being obtained by etching Ni or an Ni alloy with an etching solution consisting of an aqueous solution containing $FeCl_3$, distilling a mother liquor at the atmospheric pressure after crystallization and separation thereof to reduce the HCl concentration in the mother liquor, and distilling, at a reduced pressure, a concentrate obtained upon distillation at the atmospheric pressure to further reduce the HCl concentration, thereby obtaining an aqueous solution containing $FeCl_3$, or bringing the concentrate obtained by distillation at the atmospheric pressure into contact with an iron oxide to cause HCl in the concentrate to react with the iron oxide to further reduce the HCl concentration in the concentrate thereby obtaining the aqueous solution containing $FeCl_3$ with little HCl.

9 Claims, 2 Drawing Sheets

METHOD OF TREATING NICKEL-CONTAINING ETCHING WASTE FLUID

BACKGROUND OF THE INVENTION

1. Field of the Invention

The present invention relates to a method of treating an etching waste fluid and, more particularly, to a method of regenerating a waste fluid produced when nickel or an iron alloy containing nickel such as invariable steel (Invar) is etched with an aqueous solution containing $FeCl_3$.

2. Description of the Related Art

In recent years, along with developments of televisions, OA equipment, and computers, demand has arisen for a high-precision, high-quality CRT. A high nickel alloy such as Invar has been used as a material of CRT shadow masks. In etching of a shadow mask material consisting of such an alloy, or pure nickel, an aqueous solution containing high-concentration $FeCl_3$ is used as an etching solution since it allows a moderate and reliable reaction and is free from generation of gases.

During etching using the aqueous $FeCl_3$ solution, when a metal such as nickel and iron constituting a shadow mask material is partially dissolved, $FeCl_3$ is reduced into $FeCl_2$. Meanwhile, iron and nickel are dissolved in the aqueous $FeCl_3$ solution, into $FeCl_2$ and $NiCl_2$, respectively.

$FeCl_2$ produced in the etching solution is oxidized using chlorine gas, or $H_2O_2$ in the presence of hydrochloric acid and is easily converted into $FeCl_3$. In the course of continued operation of this method, the content of $NiCl_2$ is increased in the etching system, and eventually the solution cannot be used in practice in view of the reaction rate and chemical equilibrium. In order to circularly use the etching solution, a part of the etching solution is removed as an etching waste fluid, the nickel component is removed from the fluid, and the regenerated solution is returned to the etching system.

Various means are proposed as methods of eliminating nickel from such an etching waste fluid. Those are, (a) a method of electrolyzing a waste fluid to perform cathodic reduction, thereby precipitating metallic nickel (Published Unexamined Japanese Patent Publication No. 59-31868), (b) a method of precipitating and separating nickel as a complex by using a complexing agent such as glyoxime having selectivity for nickel (Published Unexamined Japanese Patent Publication No. 59-190367), (c) a method of substituting $Cl^-$ and precipitating nickel using metallic iron and oxidizing $Fe^{2+}$ into $Fe^{3+}$ using chlorine (Published Examined Japanese Patent Publication No. 61-44814), (d) a method of cooling an etching waste fluid after concentration by heating to eliminate an $FeCl_2.4H_2O$ crystal, firstly supplying HCl gas while cooling the mother liquor to 5° to −10° C. to recover only nickel in the form of an $NiCl_2$ crystal, and stripping HCl from the treated solution, thereby recovering the treated solution as an $FeCl_3$ concentrate, and at the same time the stripped and recovered HCl is recycled to the cooling and crystallization step (Published Examined Japanese Patent Publication No. 63-10097), and (e) a method of absorbing HCl gas in an etching waste fluid and crystallizing and separating both $NiCl_2$and $FeCl_2$, heating and distilling the mother liquor to partially remove HCl gas and water, adding water and iron pieces to the residual solution to neutralize it, and oxidizing the solution with $Cl_2$ (Published Unexamined Japanese Patent Publication No. 62-222088).

There is also proposed a method of extractively distilling the recovered hydrochloric acid using $FeCl_3$as an extracting medium, thereby extracting high-concentration HCl (Published Examined Japanese Patent Publication No. 63-10097).

In method (a) of all the conventional methods described above, standard precipitation electrode potentials of $Fe^{2+}$ and $Ni^{2+}$ are close to each other, and nickel tends to cause generation of an overvoltage. It is difficult to selectively reduce and precipitate only nickel. In addition, $Fe^{3+}$ is reduced to result in an economical disadvantage. Although method (b) has a high nickel elimination rate, the complexing agent is expensive. Since nickel generally need not be perfectly eliminated, a high nickel elimination rate does not mean a prominent merit. In method (c), since nickel is not precipitated until $Fe^{3+}$ is entirely reduced into $Fe^{2+}$, a large amount of $FeCl_2$ is produced. A large amount of $Cl_2$ is required to oxide the large amount of $FeCl_2$. Therefore, method (c) is not necessarily a good method of recovering $FeCl_3$. Although method (d) is one of the most preferable methods, the etching waste fluid must be cooled to a temperature falling within the range of 5° to −10° C., and power cost for cooling is increased. In addition, the treated solution is recovered as an aqueous $FeCl_3$ solution by simple distillation at atmospheric pressure alone. According to the experiences of the present inventors, it is difficult to sufficiently remove hydrochloric acid in the etching solution to be regenerated and circulated by only such a simple atmospheric distillation alone. When the etching solution contains free hydrogen chloride in an amount exceeding a predetermined limit, hydrogen is produced upon etching. From this point of view and the like, precise and stable operations may be interfered, and a safety problem may be posed. When high-precision etching is required as in etching of a CRT shadow mask, a large amount of metallic iron or iron oxide must be charged into the recovered iron chloride solution as in method (e), in order to neutralize the free hydrochloric acid.

In the neutralization method using the iron component, iron reacts with HCl to produce dangerous hydrogen and at the same time reacts with $FeCl_3$. Thus, the amount of $Fe^{2+}$ is undesirably increased. In order to recover an etching $Fe^{3+}$ component, consumption of an oxidant is increased too much. Examples of an easily obtainable iron oxide used for neutralizing HCl are $Fe_3O_4$ and $Fe_2O_3$. When the former example is taken into consideration as a complex oxide of $FeO.Fe_2O_3$, the FeO component is relatively easy to be dissolved. The $Fe_2O_3$ component including the latter example as well is difficulty soluble with HCl, thus posing a problem. Problems to be solved are to explore a first method capable of easily dissolving an iron oxide even if HCl having a relatively low concentration is used and a second method of decreasing the HCl concentration in the aqueous $FeCl_3$solution containing HCl after nickel elimination from the etching waste fluid without producing a large amount of $FeCl_2$ as an application of the first method.

In the method of crystallizing $NiCl_2$ upon absorption of HCl, a water-containing $NiCl_2$ crystal, a coprecipitated $FeCl_2$ crystal, or a sludge containing a corrosive material such as $FeCl_3$ contained in the mother liquor in a high concentration is produced. It is difficult to treat these products. In addition, there is no effective process for systematically recovering HCl having a high concentration. The extractive distillation using $FeCl_3$ and described in Published Examined Japanese Patent Publication No. 63-10093 does not provide an important effect as expected on the vapor-liquid equilibrium. The extractive distillation with $FeCl_3$ itself is unstable, and a precipitate which is assumed to be an iron oxide tends to be produced. Therefore, it is difficult to use this extractive distillation.

SUMMARY OF THE INVENTION

It is an object of the present invention to provide a new method of regenerating an etching waste fluid, wherein a problem associated with a treatment of an Ni-containing sludge can be solved, free HCl in a recovered circulating solution can be reduced, HCl gas having a high concentration can be systematically and economically regenerated, and the regenerated solution can be circularly used.

According to the present invention, there is provided a method of regenerating an etching waste fluid, comprising the steps of: (a) dissolving HCl gas in an etching waste fluid at a temperature falling within a range of 20° C. to 50° C. and crystallizing and separating $NiCl_2$ and $FeCl_2$ crystals, the etching waste fluid containing $NiCl_2$, $FeCl_3$, and $FeCl_2$ and being obtained by etching Ni or an Ni alloy with an etching solution consisting of an aqueous solution containing $FeCl_3$; (b) distilling the mother liquor obtained in step (a) at an atmospheric pressure upon crystallization to reduce an HCl concentration in the mother liquor; and (c) distilling, at a reduced pressure, the concentrate obtained upon distillation at the atmospheric pressure to further reduce the HCl concentration, thereby obtaining an aqueous solution containing $FeCl_3$.

According to the present invention, there is provided a method of regenerating an etching waste fluid, comprising the steps of: (a) dissolving HCl gas in an etching waste fluid at a temperature falling within a range of 20° C. to 50° C. and crystallizing $NiCl_2$and $FeCl_2$ crystals, the etching waste fluid containing $NiCl_2$, $FeCl_3$, and $FeCl_2$ and being obtained by etching Ni or an Ni alloy with an etching solution consisting of an aqueous solution containing $FeCl_3$; (b) distilling the mother liquor thus obtained at an atmospheric pressure upon crystallization to reduce an HCl concentration in the mother liquor; and (c) bringing a condensate obtained by distillation at the atmospheric pressure into contact with an iron oxide to cause HCl in the concentrate to react with the iron oxide to further reduce the HCl concentration in the concentrate, thereby obtaining the aqueous solution containing $FeCl_3$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
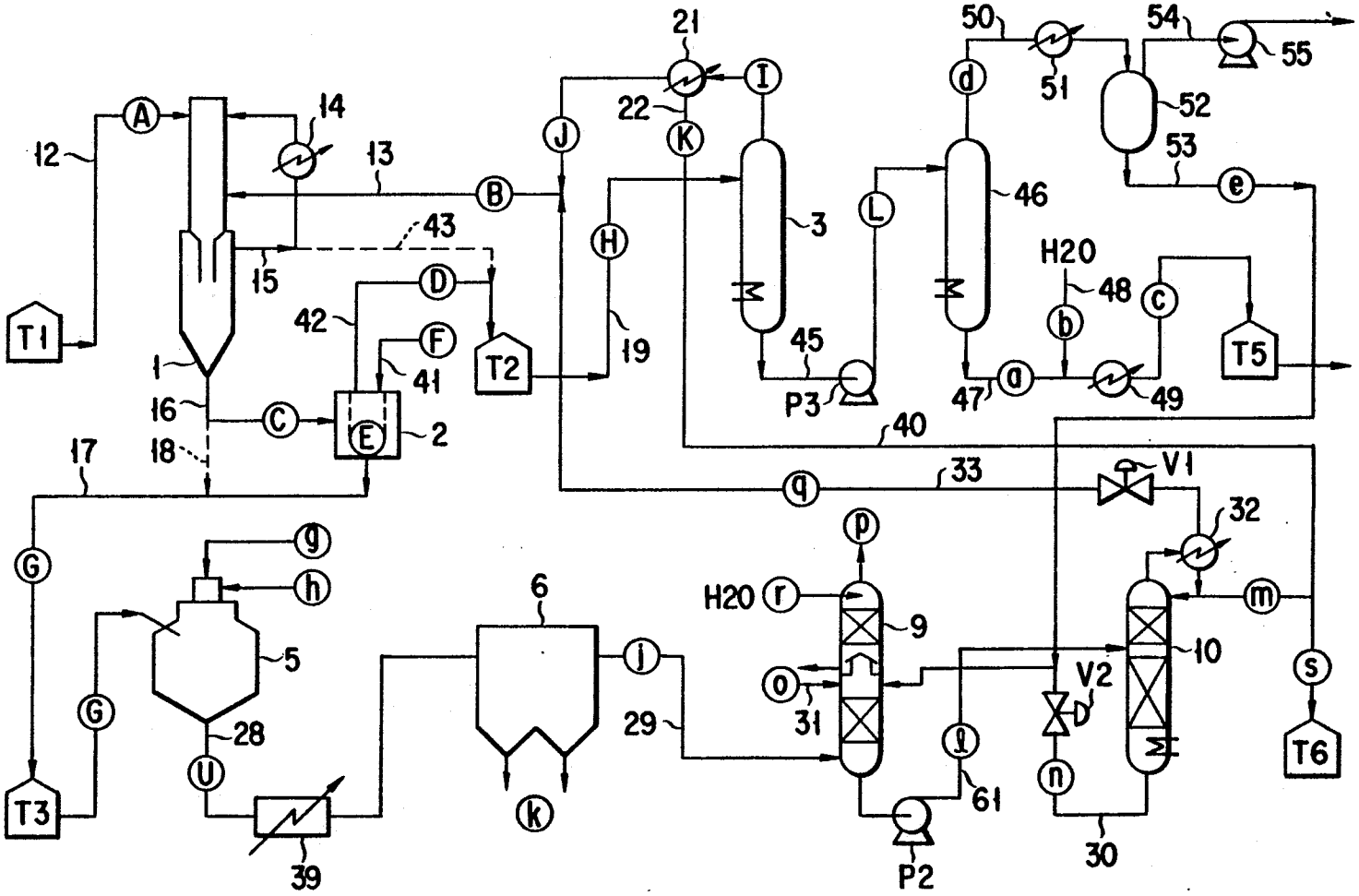
FIG. 1 is a flow chart showing a process for treating an etching waste fluid according to an embodiment of the present invention.

The present invention provides a method of dissolving HCl gas in an etching waste fluid containing $NiCl_2$, $FeCl_3$, and $FeCl_2$ and being wasted in the step of etching Ni or an Ni alloy using an aqueous $FeCl_3$ solution, removing HCl from the $FeCl_3$ containing a large amount of HCl after crystallization and separation of $NiCl_2$ and $FeCl_2$ crystals, and circulating a solution containing a small amount of HCl to the etching step.

The method of regenerating an etching waste fluid according to the present invention preferably comprises the following steps:

(a) absorbing HCl in an etching waste fluid, and at a temperature of 20° C. to 50° C. crystallizing and separating $NiCl_2$;

(b) because the mother liquor in the step (a) contains a large amount of HCl, heating the mother liquor to distill off HCl and $H_2O$ at the atmospheric pressure and concentrate the mother liquor until an azeotropic point of hydrochloric acid corresponding to the salt concentration of the mother liquor, and fractioning and the distilled HCl-$H_2O$ gas mixture to obtain HCl having a high concentration;

(c) heating a concentrate of the step (b) at a reduced pressure so that a heat conduction surface temperature of a liquid contact surface is 150° C. or less, a wall surface which contacts a gaseous phase is nearly always wet, and a solution temperature is 120° C. or less and a solidification point or more, so as to distill off HCl and $H_2O$ and concentrate the solution until a water content of the liquid phase system corresponds to that of $FeCl_3.2.5H_2O$ or less or becomes almost that of $FeCl_3.2H_2O$, thereby obtaining an $FeCl_3$solution almost free from HCl; or (c') adding an iron oxide to the concentrate obtained in the step (b) and further adding a component (e.g., $Cl_2$) for accelerating dissolution of the iron oxide as needed to cause the component to react with HCl, thereby obtaining an $FeCl_3$ solution having a small amount of HCl; and (d) thermally decomposing a chloride crystal portion obtained in the step (a) to obtain an Ni-Fe composite oxide and performing pressure distillation or extractive distillation after the produced HCl is absorbed in water, thereby obtaining HCl having a high concentration.

The HCl having a high concentration, produced in the steps (b) and (d) can be used for crystallization in the step (a). The iron oxide used in the step (c') is not limited to an external iron oxide, but can be an internal iron oxide obtained by calcining at least one of the mother liquor free from $NiCl_2$ obtained in the above step, the condensate obtained in the step (b), and the FeCl 3 solution in the step (c) or (c') . In addition, an HCl-containing gas obtained in this step may be used in the step (d).

In association with the step (c'), the present inventors made extensive studies to find a method of increasing the dissolution rate of $Fe_2O_3$ in HCl and found that the reaction rate between $Fe_2O_3$ and HCl could be greatly increased in the presence of $Cl_2$ and/or a precursor of $Cl_2$ (e.g., $ClO_2$) in the reaction system. In addition, the present inventors were also successful in an immediate decrease in HCl concentration to a practical range when the above method was applied to the HCl-containing aqueous $FeCl_3$ solution obtained upon nickel elimination of the nickel-based etching waste fluid.

That is, the present inventors found a satisfactory solution in which $Fe_2O_3$ was dissolved in HCl in the presence of $Cl_2$ or $ClO_2$ as its precursor. Note that various types of materials such as iron ores, pyrite cinder and a roasted product of pickling waste fluid may be used for $Fe_2O_3$ source in accordance with application purposes and economical advantages.

Pure $FeCl_3.2H_2O$ has a melting point of about 74° C. However, when it absorbs HCl or the like, its melting point is decreased. In the present invention, since $FeCl_3.2H_2O$ contains a small amount of impurities, it may not be solidified at down to about 60° to 70° C. In order to assure fluidity in a continuous operation, heat insulation and heating of the associated vessels and pipes must be taken into consideration.

A method according to the present invention will be described with an illustrated flow chart.

When an nickel plate or a nickel alloy plate such as Invar is etched with an aqueous $FeCl_3$ solution, nickel and iron are dissolved in the etching solution to produce $NiCl_2$ and $FeCl_2$. In a normal operation, the etching solution is supplied to an oxidation tank (not shown) to maintain the $FeCl_3$ concentration constant, and $FeCl_2$ in the etching solution is oxidized with $Cl_2$ into $FeCl_3$, thereby restoring the original $FeCl_3$ concentration. The resultant $FeCl_3$ solution is mixed with make-up $FeCl_3$supplied independently of the above $FeCl_3$, as needed. The resultant $FeCl_3$ solution is then used.

When the $NiCl_2$ concentration in the etching solution exceeds a given value, e.g., 5 wt % or more, the etching solution becomes unsuitable for etching. The etching solution is, therefore, partially removed and the removed portion as an etching waste fluid is regenerated. This waste fluid generally contains about 40 to 50 wt % of $FeCl_3$, about 0 to 10 wt % of $FeCl_2$, and 2 to 5 wt % of $NiCl_2$.

Referring to FIG. 1, reference symbol T1 denotes a reservoir for an etching waste fluid. The waste fluid is supplied to a crystallization tank 1 through a pipe 12 and is brought into contact with HCl gas having a high concentration (e.g., almost 100%) supplied from a pipe 13, thereby absorbing HCl. Since HCl absorption is an exothermic reaction, a solution extracted from the crystallization tank 1 is circulated through a pipe 15 and is cooled by a cooler 14, thereby maintaining the interior of the tank 1 at a predetermined temperature. This cooling scheme may be substituted with another cooling scheme. It is remarkable in the method of this embodiment that the temperature of the interior of the tank 1 falls within the range of 20° to 50° C. and preferably 35° to 40° C., and a temperature difference $\Delta T$ (i.e., the difference between the cooling water temperature and the crystallization temperature) can be set large, and cooling water is easily supplied. Further, it is also important to sufficiently absorb HCl to accelerate crystallization of $NiCl_2$.

It is known that the solubilities of $NiCl_2$ and $FeCl_2$ are decreased by HCl absorption due to a common ion effect, while $FeCl_3$ is converted into chloroferrate ($HFeCl_4$) or the like, so that its solubility is remarkably increased. However, when the crystallization temperature exceeds 50° C., the solubility of $NiCl_2$ is increased, and separation efficiency is degraded. The residual amount of $NiCl_2$ in the mother liquor is increased, resulting in inconvenience. When the crystallization temperature is less than 20° C., a freezing device must be used to result in high cost.

A slurry containing the $NiCl_2.2H_2O$ crystal as a major component crystallized in the crystallization tank 1 is supplied from the bottom of the crystallization tank 1 to a crystal separator 2 through a pipe 16. The crystal separator 2 separates water-containing crystals such as $NiCl_2$ and $FeCl_2$ crystals. $FeCl_3$ or $HFeCl_4$ is supplied together with free HCl as a mother liquor to a reservoir T2. The crystals separated by the crystal separator 2 are dissolved again with a small amount of water 41, and this aqueous solution is supplied to a calcination furnace 5 through a reservoir T3 through a pipe 17 and is calcined at a temperature of 550° C. to 950° C., thereby obtaining so-called nickel ferrite.

Since the aqueous solution of the crystal is calcined as described above, separation of the mother liquor from the crystals in the separator 2 need not be perfect. The crystals may contain a certain amount of mother liquor in accordance with a target Ni-Fe composite oxide composition. For this reason, it is possible to directly supply an Ni-containing sludge or slurry precipitated at the bottom of the crystallization tank to the reservoir T3 through a pipe 18, as indicated by a dotted line, and to calcine it without passing through the separator 2. In this case, the sludge or slurry is supplied to the reservoir T2 by partially removing a supernatant liquid circulated through the pipe 15.

In calcination of the Ni-containing sludge or slurry, a parallel flow type spray calcination method as disclosed in Published Unexamined Japanese Patent Publication No. 1-192708 is suitably used to prevent a composition discrepancy with an Ni component since $FeCl_3$is highly volatile. The resultant Ni-Fe composite oxide is recovered by gas/solid phase separation by a dust collector such as an electrostatic precipitator 6 and is obtained as a product. $ZnCl_2$, $CoCl_2$, or the like may be added as a ferrite effective component, and the resultant mixture may be calcined and modified, as a matter of course.

The nickel depleted solution free from nickel as the supernatant liquid discharged from the cooled crystallization tank 1 is supplied to the reservoir T2 through the pipe 15 and a pipe 43 (indicated by a dotted line) or as a mother liquor 42 from the separator 2. This solution is then supplied to an HCl recovery distillation column 3 through a pipe 19. The solution free from nickel is distilled in the distillation column 3 such that about $\frac{2}{3}$ of HCl and about $\frac{1}{4}$ or more of $H_2O$ are removed from the column top. The distilled HCl-$H_2O$ gas mixture is cooled and fractioned by a fractionator 21, so that the gas mixture is separated into HCl gas having almost a 100% concentration and hydrochloric acid 22 having about a 35% concentration. A part of the recovered hydrochloric acid is pressurized through a pipe 40 and is supplied to the upper stage of a pressure distillation column 10 and is used to recover HCl having a high concentration. An extra portion of the hydrochloric acid is supplied to a reservoir T6.

The HCl concentration in the solution at the bottom of the HCl distillation column 3 is preferably minimized. However, when the solution temperature exceeds 115° C. and particularly 120° C., formation of a material regarded as an iron oxide as a result of hydrolysis is increased. The solution temperature should not therefore exceed 120° C. According to the present invention, concentration is performed at the atmospheric pressure up to this temperature up to a concentration corresponding to this temperature. At this time, the concentration of the solution at the bottom of the column is given by 50 to 60 wt % of $FeCl_3$, 15 to 8 wt % of HCl and the balance of $H_2O$ as major components. The solution temperature falls preferable within the range of 100° to 120° C. When the solution temperature exceeds this temperature range, the corrosive properties are so rapidly increased that the solution temperature must be controlled to be 120° C. or less in favor of easy maintenance of the apparatus.

Distillation in the distillation column 3 may be started at a reduced pressure. However, since the HCl concentration is high in the initial period of distillation, distillation is started at the atmospheric pressure because a trouble may not be caused by precipitation of solid substances such as $Fe_2O_3$ and $FeCl_3$ in the solution and at a gas-liquid interface (it tends to be set at a high temperature even at the atmospheric pressure) on account of the above mentioned reason and because power consumption may then be reduced. Subsequently, distillation is performed at a reduced pressure in a reduced-pressure distillation column 46 to finish HCl depletion under the conditions defined in this specification.

Figure 2:
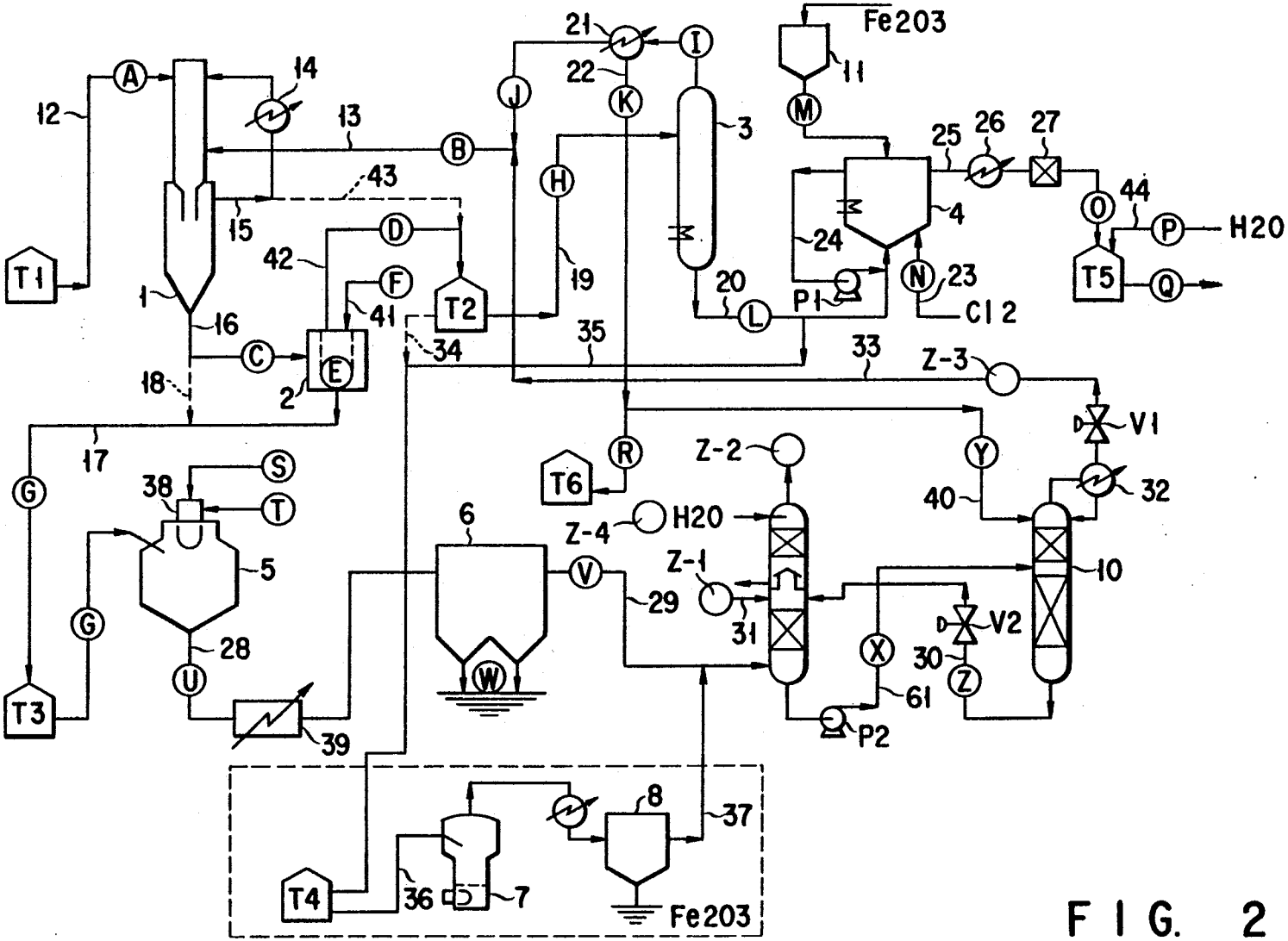
FIG. 2 is a flow chart showing a process for treating an etching waste fluid according to another embodiment of the present invention.

There are two methods of decreasing the free hydrochloric acid component in a solution discharge from the bottom portion of the HCl recovery distillation column 3. According to the first method, the solution is heated and concentrated at a reduced pressure and a temperature defined such that a heat conduction surface temperature of a liquid contact portion shown in FIG. 1 is 150° C. or less and the solution temperature is maintained at 120° C. or less and a solidification temperature or more, and HCl and $H_2O$ are distilled off such that the water content of the liquid phase system corresponds to the water content or less of $FeCl_3.2.5H_2O$ or almost equal to the water content of $FeCl_3.2H_2O$, thereby decreasing the free hydrochloric acid. According to the second method, the free hydrochloric acid is reacted with an iron oxide in the presence of $Cl_2$ as shown in FIG. 2, thereby decreasing the free hydrochloric acid.

First, the method of decreasing the free hydrochloric acid by distilling off HCl and $H_2O$ and concentrating the solution at a reduced pressure and a solution temperature of 120° C. or less such that the water content of the liquid phase system is the water content or less of $FeCl_3.2.5H_2O$ or almost equal to the water content of $FeCl_3.2H_2O$ will be described in detail below.

The solution discharged from the bottom of the HCl recovery distillation column 3 is supplied to the reduced-pressure distillation column 46 through a pipe 45. The $FeCl_3$ solution containing 15 to 8 wt % of HCl is heated at a reduced pressure and a temperature defined such that a heat transfer surface temperature of a solution contacting portion of the reduced-pressure distillation column is 150° C. or less and the solution temperature is 120° C. or less and a solidification point or more, to distill off HCl and $H_2O$ and concentrate the solution such that the water content of the liquid phase system is the water content or less of $FeCl_3.2.5H_2O$ or almost equal to the water content of $FeCl_3.2H_2O$, thereby obtaining an almost HCl depleted solution in the bottom of the reduced-pressure distillation column. In this case, the final pressure is about 60 to 100 Torr, and the solution temperature is 70° to 120° C. This temperature range is also preferable in view of corrosion materials of the apparatus.

When heating is performed in the reduced-pressure distillation column 46 not at a reduced pressure but at the atmospheric pressure to concentrate the solution to such an extent that the water content of the liquid phase system is not corresponds to the water content or less of $FeCl_3.2.5H_2O$, the solution temperature reaches about 180° C., and a material assumed to be an iron oxide caused by hydrolysis is produced in a considerable amount. It takes a long period of time with much labor to filter the material regarded as the iron oxide. This material can hardly be dissolved, thus degrading operability. According to the present invention, when the solution is heated at a reduced pressure and a temperature defined such that the heat transfer surface temperature of the solution contact portion is 150° C. or less and the solution temperature is 120° C. or less and a solidification point (i.e., ca. 75° C.) or more, concentration can be performed without producing the material regarded as an iron oxide caused by hydrolysis according to the findings of the present inventors.

When the solution temperature is the solidification point or less, the solution is rapidly solidified, and the operation becomes difficult. When concentration is performed up to about 80% of the water content of the liquid phase system which is not more than a water content of $FeCl_3.2.5H_2O$ and is not less than a water content of $FeCl_3.2H_2O$, the content of HCl becomes 0.5 wt % or less. Water is added to the solution and the concentration of $FeCl_3$ is adjusted to about 45 to 50 wt %, thereby obtaining a regenerated etching solution without crystallization and re-dissolution of $FeCl_3.2.5H_2O$.

It is important to not only set the solution temperature of the reduced-pressure distillation column to be 120° C. or less but also set the heat conduction surface temperature of the solution contact portion to be 150° C. or less. Production of the material regarded as an iron oxide near the wall surface can then be suppressed. The heater used in the present invention is preferably arranged such that its heat transfer surface is kept dipped in the solution. For example, a multi-pipe heat exchanger or a downflow liquid film heat exchanger can be used to externally circulate and heat the solution.

A jacket type heater can also be used. In this case, its heat conduction surface is kept dipped in the solution so that the wall surface which contacts a gas phase is not dried by a heating method such that the jacket surface is kept set below the solution surface level. In heating, a liquid heating medium or a steam having a constant pressure, or the like is used to prevent local overheating.

The HCl-$H_2O$ gas mixture distilled at the reduced-pressure distillation column 46 is supplied from the column top to a condenser 51 through a pipe 50, and the condensate is stored in a condensate tank 52. The distillation column is kept at a reduced pressure by a vacuum pump 55. The condensate in the tank 52 is supplied to the upper portion of an absorption and cleaning column 9 (to be described later with reference to FIG. 2) through a pipe 53 and is used for recovery of high-concentration HCl.

The solution discharged from the bottom of the reduced-pressure distillation column 46 passes through a pipe 47 and is diluted with water 48, so that the $FeCl_3$concentration is set to be 45 to 50 wt % suitable for etching. The solution is then supplied to a cooler 49 and is cooled by the cooler 49. The cooled solution is supplied to a reservoir T5 and serves as a regenerated solution.

The condensate stored in the condensate tank 52 is subjected to extractive distillation using a known extracting agent CaCl2 (e.g., U.S. Pat. No. 3,589,864) without using the pressure distillation column 10 to recover HCl having a high concentration. The recovered HCl may be used for crystallization in the crystallization tank 1.

The method of decreasing free hydrochloric acid by adding an iron oxide in the presence of $Cl_2$ will be described with reference to FIG. 2.

A solution discharged from the bottom of the HCl recovery distillation column 3 is supplied to a reaction tank 4 through a pipe 20 to decrease free hydrochloric acid. An iron oxide ($Fe_2O_3$) is supplied from a hopper 11 to the reaction tank 4 and is reacted with the free hydrochloric acid in accordance with the following reaction formula:

$$Fe_2O_3+6HCl \rightarrow FeCl_3+3H_2O$$

In this case, when $Cl_2$ gas is supplied from a pipe 23 and is present together with $Fe_2O_3$, a dissolution reaction is extremely accelerated according to the findings of the present inventors. $Fe_3O_4$ and FeO may be used as iron oxides. In these cases, $FeCl_2$ is produced, and $Cl_2$ is consumed for oxidation. $Fe_2O_3$ is preferable as the iron oxide.

The reaction is a mixed phase reaction between the solid phase and the liquid phase and is preferably performed with stirring. In a preferred embodiment of the present invention, a stirring effect is obtained by externally circulating the reaction solution through a pipe 24 by a pump P1. A conventional stirrer may be used in place of the pump P1, as a matter of course. In this embodiment, an iron oxide is charged into the $FeCl_3$solution and is reacted with $FeCl_3$. However, the solution may be poured into a column in which an iron oxide is stored, thereby causing a reaction between $FeCl_3$ and the iron oxide.

The function of $Cl_2$ as a reaction accelerator used in this embodiment is not clear yet. It is, however, assumed that $Cl_2$ serves as a catalyst. The solubility of $Cl_2$ in the aqueous $FeCl_3$ solution is smaller than that in distilled water, and the amount of $Cl_2$ used in this reaction is small. An extra portion of $Cl_2$ can be used for oxidizing $FeCl_2$ to reactivate the etching solution and is not wasted. The residence time falls within the range of 30 minutes to 5 hours.

The reaction solution in the reaction tank 4 is discharged through a pipe 25 and is cooled by a cooler 26, and the iron oxide contained in the reaction solution is separated by a filter 27 and a precipitation tank (not shown). The separated iron oxide is supplied to the reservoir T5. The concentration of the iron oxide is adjusted, and the adjusted iron oxide is used again. Note that if the reaction between the iron oxide and residual HCl and cooling thereof can be performed over a long period of time upon direct storage in the reservoir T5, forcible cooling and filtration need not be performed. In this case, the size of the reaction tank 4 can be reduced.

Metal iron or an active compound (e.g., iron hydroxide or iron carbonate) for HCl may be used to finally adjust the HCl concentration. Water 44 is added 10 to the reservoir T5 to adjust the concentration, thereby obtaining a regenerated solution.

An exhaust gas from the dust collector 6 contains a large amount of HCl, and this HCl must be recovered. The exhaust gas is supplied to the bottom portion of the absorption elimination column 9 through a pipe 29. The solution at the bottom of the pressure distillation column 10 kept at 2 atm. is extracted to a pipe 30 and supplied to the upper absorption portion of the absorption elimination column 9. This solution is cooled by a cooler (not shown), and the pressure of the solution is reduced by a pressure reduction valve V2. The pressure-reduced solution is returned to absorb HCl. Reference numeral 31 denotes replenishing water. The solution which absorbed HCl is discharged from the bottom of the column, and the pressure of this solution is increased to about 2 atm. by a pump P2. The solution is supplied to the middle portion of the pressure distillation column 10 through a pipe 41.

The upper portion of the absorption elimination column 9 is a washing column for reducing the concentration of the nonabsorbed HCl in the exhaust as below an environmental standard value and for discharging the washed exhaust gas to outer air. Water and/or an alkali and the like are used as absorption solutions. HCl gas having a concentration of almost 100% and having passed through a fractionator 32 is discharged from the top of the pressure distillation column 10 and is set at almost the atmospheric pressure through a pressure reduction valve V1. The resultant gas is returned to the crystallization tank 1 thorough a pipe 33 and the pipe 13.

The above description exemplifies that when the concentration of the free hydrochloric acid is to be reduced by causing the free hydrochloric acid to react with the iron oxide in the presence of $Cl_2$, the iron oxide is replenished as a commercially available product. However, the iron oxide may be self-replenished as follows.

when an iron-containing alloy is to be etched using an etching solution, an iron chloride ($FeCl_2$ or $FeCl_3$) is naturally and inevitably accumulated due to the nature of the reaction and process . The following method is very effective when the treatment of the extra portion of iron chloride is difficult, or the iron oxide is not easily accessible.

In the method of the present invention, a large amount of iron chloride solution serving as a source for the iron chloride is present in the system. More specifically, the crystallized and separated mother liquor in the reservoir T2 is extracted through a pipe 34 (indicated by a dotted line), or the solution at the bottom of the HCl recovery distillation column 3 is branched from the pipe 20 and is discharged to a pipe 35. Alternatively, the regenerated solution in the reservoir T5 may be suitably utilized as a material for the iron oxide. Reference symbol T4 denotes a reservoir used for this source solution as needed. The source solution is fluidization-roasted in the fluidized bed roasting furnace 7, thereby obtaining the iron oxide.

The roasting temperature falls within the range of 550° C. to 950° C. to obtain an $Fe_2O_3$ product. If roasting is performed at a high temperature, the solubility of the produced iron oxide with respect to hydrochloric acid is reduced. Therefore, the solution is preferably roasted at a low temperature to reduce the concentration of HCl. In particular, if the iron oxide is used for only a reaction with HCl, the solution is preferably hydrolyzed at a lower temperature. This roasting can be performed in a spray roaster used in preparing the Ni-Fe composite oxide as described above. If slight contamination is allowed, the roasting furnace 5 is commonly used to perform alternate reactions. In addition, as described above, a composite oxide can be obtained by adding a third component such as Zn or Co.

The iron oxide powder discharged from the roasting furnace 5 is recovered by a dust collector such as the electrostatic precipitator 8 and is transferred to the hopper 11. The iron oxide powder is used as a source iron oxide for reducing the HCl concentration. The exhaust gas discharged from the electrostatic precipitator 8 contains a large amount of HCl and is merged with the exhaust gas in an exhaust gas pipe 29 for Ni-Fe composite oxide preparation through a pipe 37. The HCl in the gas mixture is recovered by the absorption elimination column 9 and the pressure distillation column 10. As a result, HCl having a concentration of almost 100% is supplied to the crystallization tank 1.

When the roasting furnace 7 is used together with calcination furnace 5 or when the roasting furnace 5 is also made serve as the roasting apparatus to hydrolyze and roast the extra portion of iron chloride, production of the excessive $FeCl_3$ solution which is hard to treat can be eliminated. Nickel ferrite which can be used in a variety of applications, magnetic iron oxide, and a 35% hydrochloric acid, all of which are useful substances, can be obtained. Only a small amount of an absorption waste fluid (e.g., diluted hydrochloric acid or its neutralized solution NaCl) of the elimination column is discharged.

EXAMPLE 1

Reduced-pressure distillation (step (c)) at a solution temperature of 120° C. or less was performed by a free hydrochloric acid reducing method in accordance with a flow chart of FIG. 1. Operation results are shown in Tables 1 to 3.

TABLE 1

| | Step Step (a) Position Letter | | | | | | |
|---|---|---|---|---|---|---|---|
| | A | B | C | D | E | F | G |
| | Name | | | | | | |
| | Etching Waste Fluid | HCl Gas | Slurry at Outlet Crystallization Tank | Mother Liquor Free from $NiCl^2$ | Separated Crystal | Water Containing Separated Crystal | Solution Containing $NiCl_2$ |
| Temperature (°C.) | 25 | 60 | 40 | 40 | 40 | 25 | 25 |
| Unit of Flow Rate | Kg/h | Kg/h | Kg/h | Kg/h | Kg/h | Kg/h | Kg/h |
| FeCl | 1350 | — | 1350 | 1139.4 | 210.6 | — | 210.6 |
| $FeCl_2$ | 90 | — | 90 | — | 90 | — | 90 |
| $NiCl_2$ | 120 | — | 120 | 3.0 | 117 | — | 117 |
| HCl | 6 | 688.7 | 694.7 | 615.5 | 79.2 | — | 79.2 |
| $H_2O$ | 1434 | — | 1434 | 1139.4 | 294.6 | 536.4 | 1086 |
| $Fe_2O_3$ | — | — | — | — | — | — | — |
| $Cl_2$ | — | — | — | — | — | — | — |
| Total | 3000 | 688.7 | 3694.7 | 2897.3 | 791.4 | 536.4 | 1582.8 |

Note:
*Corresponds to a solution charged in a spray roasting furnace.

TABLE 2

| | Step Step (b) Position Letter | | | | |
|---|---|---|---|---|---|
| | H | I | J | K | L* |
| | Name | | | | |
| | Solution Charged in Distillation Column | Gas at Top of Distillation Column | 100% HCl Gas | Fraction: 35% HCl | Solution at Bottom of Distillation Column |
| Temperature (°C.) | 40 | 120 | 60 | 60 | 120 |
| Unit of Flow Rate | Kg/h | Kg/h | Kg/h | Kg/h | Kg/h |
| FeCl | 1139.4 | — | — | — | 1139.4 |
| $FeCl_2$ | — | — | — | — | — |
| $NiCl_2$ | 3.0 | — | — | — | 3.0 |
| HCl | 615.5 | 469.6 | 301 | 168.6 | 145.8 |
| $H_2O$ | 1139.4 | 313 | | 313 | 826.6 |
| $Fe_2O_3$ | — | — | — | — | — |
| $Cl_2$ | — | — | — | — | — |
| Total | 2897.3 | 782.6 | 301 | 481.6 | 2114.8 |

| | Step Step (c) Position Letter | | | | |
|---|---|---|---|---|---|
| | a | b | c | d | e |
| | Name | | | | |
| | Solution at Bottom of Pressure-Reduced Distillation Column | Added Water | Regenerated Solution | Gas at Top of Pressure-reduced Distillation Column | Condensate: 21% HCl |
| Temperature (°C.) | 110 | 25 | 40 | 110 | 40 |
| Unit of | Kg/h | Kg/h | Kg/h | Kg/h | Kg/h |

TABLE 2-continued

| | | | | | |
|---|---|---|---|---|---|
| Flow Rate | | | | | |
| FeCl | 1139.4 | — | 1139.4 | — | — |
| $FeCl_2$ | — | — | — | — | — |
| $NiCl_2$ | 3.0 | — | 3.0 | — | — |
| HCl | 4.0 | — | 4.0 | 141.8 | 141.8 |
| $H_2O$ | 302.9 | 883 | 1185.9 | 523.7 | 523.7 |
| $Fe_2O_3$ | — | — | — | — | — |
| $Cl_2$ | — | — | — | — | — |
| Total | 1449.3 | 883 | 2332.3 | 665.5 | 665.5 |

Note:
*Corresponds a solution charged in a pressure-reduced distillation column in the Step (c) or a solution charged in a reaction tank in the step (c').

TABLE 3

| | Step Step (d) Position Letter | | | |
|---|---|---|---|---|
| | g | h | i | j |
| | Name | | | |
| | Roasting Furnace LPG | Combustion Air | Gas at Outlet of Calcination Furnace | EP Outlet Gas |
| Temperature (°C.) | 25 | 25 | 950 | 350 |
| Unit of Flow Rate | Kg/h | Kgmol/h | Kgmol/h | Kmol/h |
| $O_2$ | — | 70.7 | 17.9 | 17.9 |
| $N_2$ | — | 266.1 | 226.1 | 226.1 |
| $CO_2$ | — | — | 31.8 | 31.8 |
| HCl | — | — | 9.3 | 9.3 |
| $H_2O$ | — | — | 98.5 | 98.5 |
| $Fe_2O_3$ | — | — | 160.4# | — |
| $NiO_2$ | — | — | 67.4# | — |
| LPG | 466.2 | — | — | — |
| Total | 466.2 | 336.8 | 423.6 | 4236.8 |

| | Step Step (d) Position Letter | | | |
|---|---|---|---|---|
| | k | l | m | n |
| | Name | | | |
| | Ni—Fe composite Oxide | HCl-Absorbed Solution | 35 % HCl | Solution at Bottom of Pressure EP Distillation Column |
| Temperature (°C.) | 350 | 82 | 60 | 120 |
| Unit of Flow Rate | Kg/h | Kg/h | Kg/h | Kg/h |
| $O_2$ | — | — | — | — |
| $N_2$ | — | — | — | — |
| $CO_2$ | — | — | — | — |
| HCl | — | 3746.3 | 93.7 | 3265.2 |
| $H_2O$ | — | 14093.8 | 174.0 | 13919.8 |
| $Fe_2O_3$ | 160.4 | — | — | — |
| $NiO_2$ | 67.4 | — | — | — |
| LPG | — | — | — | — |
| Total | 227.8 | 17840.3 | 267.7 | 17185.0 |

| | Step Step (d) Position Letter | | | | |
|---|---|---|---|---|---|
| | o | p | q | r | s |
| | Name | | | | |
| | Water Supplied to Absorption Column | Exhaust Gas | 100% HCl of Pressure Distillation Column | Cleaning Water | Recovered 35% HCl |
| Temperature (°C.) | 25 | 78 | 60 | 25 | 60 |
| Unit of Flow Rate | Kg/h | Kgmol/h | Kg/h | Kg/h | Kg/h |
| $O_2$ | — | 17.9 | — | — | — |
| $N_2$ | — | 266.1 | — | — | — |
| $CO_2$ | — | 31.8 | — | — | — |
| HCl | — | — | 387.6 | 541.8 | 208.3 |
| $H_2O$ | 1747.2 | 254.1 | — | — | 386.8 |
| $Fe_2O_3$ | — | — | — | — | — |
| $NiO_2$ | — | — | — | — | — |
| LPG | — | — | — | — | — |
| Total | 1747.2 | 560.9 | 387.6 | 541.8 | 595.1 |

EXAMPLE 2

Free hydrochloric acid was reduced by causing it to react with an iron oxide in the presence of $Cl_2$according to the free hydrochloric acid reducing method (step (C')) of the flow chart of FIG. 2. Operation results are shown in Tables 4 to 6.

TABLE 4

| | Step Step (a) Position Letter | | | | | | |
|---|---|---|---|---|---|---|---|
| | A | B | C | D | E | F | G |
| | Name | | | | | | |
| | Etching Waste Fluid | HCl Gas | Slurry at Outlet Crystallization Tank | Mother Liquor Free from $NiCl^2$ | Separated Crystal | Water Containing Separated Crystal | Solution Containing $NiCl_2$ |
| Temperature (°C.) | 25 | 60 | 40 | 40 | 40 | 25 | 25 |
| Unit of Flow Rate | Kg/h | Kg/h | Kg/h | Kg/h | Kg/h | Kg/h | Kg/h |
| FeCl | 1350 | — | 1350 | 1139.4 | 210.6 | — | 210.6 |
| $FeCl_2$ | 90 | — | 90 | — | 90 | — | 90 |
| $NiCl_2$ | 120 | — | 120 | 3.0 | 117 | — | 117 |
| HCl | 6 | 688.7 | 694.7 | 615.5 | 79.2 | — | 79.2 |
| $H_2O$ | 1434 | — | 1434 | 1139.4 | 294.6 | 536.4 | 1086 |
| $Fe_2O_3$ | — | — | — | — | — | — | — |
| $Cl_2$ | — | — | — | — | — | — | |
| Total | 3000 | 688.7 | 3694.7 | 2897.3 | 791.4 | 536.4 | 1582.8 |

Note:
*Corresponds to a solution charged in a spray roaster.

TABLE 5

| | Step | | | | | | | | | | |
|---|---|---|---|---|---|---|---|---|---|---|---|
| | Step (b) | | | | | Step (c') | | | | | |
| | Position Letter | | | | | | | | | | |
| | H | I | J | K | L | M | N | O | P | Q | R |
| | Name | | | | | | | | | | |
| | Solution Charged in Distillation Column | Gas at Top of Distil-lation Column | 100% HCl Gas | Fraction: HCl | Solution at Bottom of Distillation Column* | $Fe_2O_2$ | $Cl_2$ Gas | Solution at Outlet of Reaction Tank | Concen-tration Adjusting Water | Re-gene-rated So-lution | Re-covered 35% HCl |
| Temperature (°C.) | 40 | 120 | 60 | 60 | 120 | 25 | 25 | 100 | 25 | 40 | 60 |
| Unit of Flow Rate | Kg/h | Kg/h | Kg/h | Kg/h | Kg/h | Kg/h | Kg/h | Kg/h | Kg/h | Kg/h | Kg/h |
| $FeCl_3$ | 1139.4 | — | — | — | 1139.4 | — | — | 1349.6 | — | 1349.6 | |
| $FeCl_2$ | — | — | — | — | — | — | — | — | — | — | |
| $NiCl_2$ | 3.0 | — | — | — | 3.0 | — | — | 3.0 | — | 3.0 | |
| HCl | 615.5 | 469.6 | 301 | 168.6 | 145.8 | — | — | 4.0 | — | 4.0 | 114.6 |
| $H_2O$ | 1139.4 | 313 | | 313 | 826.6 | — | — | 861.6 | 536.4 | 1398.0 | 212.8 |
| $Fe_2O_3$ | — | — | — | — | — | 51.8 | — | — | — | — | |
| $Cl_2$ | — | — | — | — | — | — | 3.0 | 3.0 | — | 3.0 | |
| Total | 2897.3 | 782.6 | 301 | 481.6 | 2114.8 | 51.8 | 3.0 | 2221.2 | 536.4 | 2754.6 | 327.4 |

Note:
*Corresponds to a solution charged in a reaction tank.

TABLE 6

| | Step Step (d) Position Letter | | | |
|---|---|---|---|---|
| | S | T | U | V |
| | Name | | | |
| | Roasting Furnace LPG | Combustion Air | Gas at Outlet of Calcination Furnace | EP Outlet Gas |
| Temperature (°C.) | 25 | 25 | 950 | 350 |
| Unit of Flow Rate | Kg/h | Kgmol/h | Kgmol/h | Kmol/h |
| $O_2$ | — | 70.7 | 17.9 | 17.9 |
| $N_2$ | — | 266.1 | 226.1 | 226.1 |
| $CO_2$ | — | — | 31.8 | 31.8 |
| HCl | — | — | 9.3 | 9.3 |
| $H_2O$ | — | — | 98.5 | 98.5 |
| $Fe_2O_3$ | — | — | 160.4# | — |
| $NiO_2$ | — | — | 67.4# | — |
| LPG | 466.2 | — | — | — |
| Total | 466.2 | 336.8 | 423.6 | 423.6 |

Step
Step (d)

TABLE 6-continued

| | Position Letter | | | |
|---|---|---|---|---|
| | W | X | Y | Z |
| | Name | | | |
| | Ni—Fe composite Oxide | HCl-Absorbed Solution | 35% HCl | Solution at Bottom of Pressure Distillation Column |
| Temperature (°C.) | 350 | 82 | 60 | 120 |
| Unit of Flow Rate | Kg/h | Kg/h | Kg/h | Kg/h |
| $O_2$ | — | — | — | — |
| $N_2$ | — | — | — | — |
| $CO_2$ | — | — | — | — |
| HCl | — | 3037.3 | 54.0 | 2703.7 |
| $H_2O$ | — | 11426.1 | 100.2 | 11526.3 |
| $Fe_2O_3$ | 160.4 | — | — | — |
| $NiO_2$ | 67.4 | — | — | — |
| LPG | — | — | — | — |
| Total | 227.8 | 14463.4 | 154.2 | 14230.0 |

| | Step Step (d) Position Letter | | | |
|---|---|---|---|---|
| | Z-1 | Z-2 | Z-3 | Z-4 |
| | Name | | | |
| | Water Supplied to Absorption Column | Exhaust Gas | 100% HCl of Pressure Distillation Column | Cleaning Water |
| Temperature (°C.) | 25 | 78 | 60 | 25 |
| Unit of Flow Rate | Kg/h | Kgmol/h | Kg/h | Kg/h |
| $O_2$ | — | 17.9 | — | — |
| $N_2$ | — | 266.1 | — | — |
| $CO_2$ | — | 31.8 | — | — |
| HCl | — | — | 387.6 | 541.8 |
| $H_2O$ | 2654 | 254.1 | — | — |
| $Fe_2O_3$ | — | — | — | — |
| $NiO_2$ | — | — | — | — |
| LPG | — | — | — | — |
| Total | 2654 | 560.9 | 387.6 | 541.8 |

Tables 4 to 6 are obtained when a fluid roasting furnace surrounded by a dotted line in the flow chart of FIG. 2 is not operated. If this portion is operated, the load of the distillation column 3 can be reduced depending on the sampling position of the source iron chloride, or the load on the pressure distillation column is increased. The load of the reaction tank 4 is continuously reduced.

Experimental examples for a reaction acceleration effect by addition of $Cl_2$ and $ClO_2$ in a reaction between the aqueous HCl solution and Fe2O3 will be described below.

Experimental Example 1

A commercially available iron oxide powder ($Fe_2O_3$; Wako Pure Chemical Reagent, Special Class) was added to 5% HCl in two equivalent weights and was moderately refluxed in a conical flask for 1.5 hours. The HCl concentration in an $FeCl_3$ solution obtained by filtering the reacted solution was 1.4 wt %.

Experimental Example 2

A reaction as in Experimental Example 1 was performed at 60° C., and the iron oxide was almost not dissolved. When a reaction was performed at 90° C., the HCl concentration in an $FeCl_3$ solution obtained by filtering the reacted solution was 4 wt %.

Experimental Example 3

Condensed HCl was intermittently poured in $KMnO_4$ in a reaction system to produce $Cl_2$. The same reaction is performed as Experimental Example 1 with bubbling $Cl_2$into the solution. A conical flask was sometimes shaken to stir the mixture. The mixture was subjected to a reaction in a hot bath at 90° C. for 1.5 hours. After the reaction, the HCl concentration in the filtrate containing $FeCl_3$ was 0.8 wt %.

Experimental Example 4

HCl was blown into an etching waste fluid obtained upon etching Invar, and $NiCl_2$, $FeCl_2$, and the like were precipitated and separated. The fluid was heated to distill and separate HCl, thereby obtaining a solution containing 50 wt % of $FeCl_3$, 0.1 wt % of $NiCl_2$, 0.1 wt % or more of $FeCl_2$, a trace amount of $MnCl_2$, and 7 wt % of HCl. An $Fe_2O_3$ powder was added eliminate to free HCl in two equivalent weights. An experiment was performed at 90° C. following the same procedures as in Experimental Example 1. After the reaction, the nonreacted $Fe_2O_3$ was filtered, and the HCl concentration of the filtrate was measured to be 3.8 wt %.

Experimental Example 5

Following the same procedures as in Experimental Example 3, $Cl_2$ gas was supplied to a reaction system as in Experimental Example 4. After the reaction, the HCl concentration of the filtrate was 0.5 wt %. The presence of $FeCl_2$ was found in neither Experimental Example 1 nor 2.

Experimental Example 6

Following the same procedures as in Experimental Example 3 except that 1 wt % of $ClO_2$ with respect to the total content of a solution was dissolved in the solution in place of supplying $Cl_2$ gas, the resultant solution was heated. After the reaction, the HCl concentration of a filtrate obtained by filtering the reacted solution was 1.5 wt %.

In the above examples, $Fe_2O_3$ was charged in the $FeCl_3$ solution and was subjected to a reaction. However, the solution may be poured into a column in which $Fe_2O_3$ is held, thereby causing a reaction.

The method of the present invention provides a method of an antipollution method of regenerating and recovering an etching waste fluid for a nickel alloy for high-precision, high-quality CRT shadow masks and has the following effects.

1. Energy can be conserved because $NiCl_2$ crystallization is performed at a rather high temperature.

2. Energy can be conserved and the apparatus can be prevented from corrosion because HCl is recovered and removed from the recovered mother liquor at a temperature up to an azeotropic start point of hydrochloric acid corresponding to the salt concentration of the mother liquor at the atmospheric pressure.

3. When residual HCl is eliminated by a reduced-pressure heating method, production of fine substances caused by hydrolysis can be prevented in specific conditions and at a low temperature, so that the process can be simplified, thereby saving the energy and preventing corrosion due to the low temperature.

4. When residual HCl is eliminated by causing it to react with an iron oxide in the presence of $Cl_2$, the reaction rate can be increased, and utilization of the iron oxide can be improved.

5. The $NiCl_2$-containing sludge is roasted to produce a useful Ni-Fe composite oxide and recover HCl, so that difficulty in treating the sludge can be removed.

6. The iron chloride solution is roasted to self-replenish an iron oxide, thus assuring the safety of the operation.

7. In association with effect 4, since $Fe_2O_3$ can be quickly converted into $FeCl_3$ using diluted HCl having a concentration lower than that corresponding to the azeotropic point (110° C., 20.8% HCl) in the normal state according to the method of the present invention, the $FeCl_3$ for treating the waste fluid can be manufactured at low cost using diluted hydrochloric acid having a low industrial value. In addition, in recovery of the etching solution according to the present invention, for example, an excessive amount of HCl can be reduced by $Fe_2O_3$. As compared with the case wherein HCl is neutralized by Fe, bivalent $FeCl_2$ is not produced, and dangerous $H_2$ is not produced either. Since the reaction temperature can be reduced, a corrosive solution can be easily handled. Since $Fe_2O_3$ can be easily obtained by hydrolyzing $FeCl_3$, self-replenishment can be performed as needed.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of regenerating an etching waste fluid containing $NiCl_2$, $FeCl_3$, and $FeCl_2$ and being obtained by etching Ni or an Ni alloy with an etching solution comprising an aqueous solution of $FeCl_3$, comprising the steps of:

(a) dissolving HCl gas in the etching waste fluid at a temperature range of 20° C. to 50° C. to thereby form $NiCl_2$ and $FeCl_2$ crystals;

(a1) separating out the $NiCl_2$ and $FeCl_2$ crystals from the etching waste fluid thereby producing a mother liquor;

(b) distilling the mother liquor at atmospheric pressure to reduce an HCl concentration in the mother liquor; and (c) distilling, at a reduced pressure, the mother liquor concentrated in step b to further reduce the HCl concentration, thereby obtaining an aqueous solution containing $FeCl_3$.

2. A method according to claim 1, wherein the step (c) comprises the step of heating the mother liquor at a temperature defined such that a heat conduction temperature of a solution contact portion is not more than 150° C. and a solution temperature is not more than 120° C. and not less than a solidification point while a wall surface which contacts a gas phase portion is kept wet.

3. A method according to claim 1, wherein the step (c) comprises the step of distilling the mother liquor such that a water content of a liquid phase is not more than a water content of $FeCl_3.2.5H_2O$.

4. A method according to claim 1, wherein the step (b) comprises the step of heating the mother liquor to about an azeotropic point of hydrochloric acid corresponding to a salt concentration of the mother liquor.

5. A method according to claim 1, further comprising the step of partially condensing a distilled gas obtained in the step to obtain a high-concentration HCl gas.

6. A method according to claim 5, wherein the high-concentration HCl gas is recycled to the step (a).

7. A method according to claim 1, further comprising the step of thermally decomposing the $NiCl_2$ and $FeCl_2$ crystals to obtain an Ni-Fe composite oxide.

8. A method according to claim 7, further comprising the steps of absorbing HCl gas produced by thermal decomposition of the $NiCl_2$ and $FeCl_2$ crystals in water, and performing pressure or extractive distillation of the water which absorbed the HCl gas to obtain a high-concentration HCl gas.

9. A method according to claim 8, wherein the high-concentration HCl gas is recycled to the step (a).

* * * * *